US012108927B2

(12) United States Patent
Yajima

(10) Patent No.: US 12,108,927 B2
(45) Date of Patent: Oct. 8, 2024

(54) VACUUM CLEANER AND VACUUM CLEANER SYSTEM

(71) Applicant: TOSHIBA LIFESTYLE PRODUCTS & SERVICES CORPORATION, Kawasaki (JP)

(72) Inventor: Yousuke Yajima, Tama Kawasaki (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 632 days.

(21) Appl. No.: 16/549,600

(22) Filed: Aug. 23, 2019

(65) Prior Publication Data

US 2020/0060493 A1 Feb. 27, 2020

(30) Foreign Application Priority Data

Aug. 24, 2018 (JP) ..... 2018-157743
Jul. 17, 2019 (JP) ..... 2019-131935

(51) Int. Cl.
*A47L 9/28* (2006.01)

(52) U.S. Cl.
CPC ..... *A47L 9/2884* (2013.01); *A47L 9/2857* (2013.01); *A47L 9/2878* (2013.01); *A47L 9/2889* (2013.01); *A47L 9/2894* (2013.01)

(58) Field of Classification Search
CPC .... A47L 9/0081; A47L 9/2842; A47L 9/2857; A47L 9/2873; A47L 9/2878; A47L 9/2884; A47L 9/2889; A47L 9/2894
See application file for complete search history.

(56) References Cited

U.S. PATENT DOCUMENTS 5,255,409 A * 10/1993 Fujiwara ..... A47L 9/2831 15/412
10,663,972 B2 5/2020 Park et al.
2017/0083023 A1* 3/2017 Park ..... G05D 1/024

FOREIGN PATENT DOCUMENTS

CN 1954766 A 5/2007
CN 106541 407 A 3/2017
CN 107913042 A 4/2018
JP S58-109021 A 6/1983
(Continued)

OTHER PUBLICATIONS

JP-2002282180-A—English Machine Translation (Year: 2002).*
(Continued)

*Primary Examiner* — Marc Carlson
(74) *Attorney, Agent, or Firm* — Oblon, McClelland, Maier & Neustadt, L.L.P.

(57) ABSTRACT

A display input part 28 displays a first element relevant to operation of an electric blower 14, and a second element having trade-off relation with the first element. The display input part 28 receives input for changing a value of at least either one of the first element and the second element. A main control part 29 obtains, on the basis of the value after change received by the display input part 28, a value of the other of the first element and the second element. An indication control part makes the display input part 28 display the value obtained by the main control part 29. A driving control part controls driving of the electric blower 14, on the basis of the value of the first element received by the display input part 28 or the value of the first element obtained through calculation by the main control part 29.

16 Claims, 12 Drawing Sheets

(56) References Cited

FOREIGN PATENT DOCUMENTS

| | | | | |
|---|---|---|---|---|
| JP | 7-213467 | A | | 8/1995 |
| JP | 2577819 | B2 | * | 2/1997 |
| JP | 2002282180 | A | * | 10/2002 |
| JP | 2005-137552 | A | | 6/2005 |
| JP | 2010-069212 | A | | 4/2010 |
| JP | 2010-69331 | A | | 4/2010 |
| JP | 2011-251024 | A | | 12/2011 |
| JP | 2012-135384 | A | | 7/2012 |
| JP | 2014-57635 | A | | 4/2014 |
| JP | 2016-22085 | A | | 2/2016 |
| JP | 2018-112917 | A | | 7/2018 |
| JP | 6924624 | B2 | * | 8/2021 |

OTHER PUBLICATIONS

JP-6924624-B2—English Machine Translation (Year: 2021).*
Japanese Office Action dated May 10, 2023, issued in Japanese Patent Application No. 2019-131935.

* cited by examiner

| USER NO. | FIRST ELEMENT | SECOND ELEMENT | USER ATTRIBUTE 1 | USER ATTRIBUTE 2 | ..... | AREA INFORMATION 1 | AREA INFORMATION 2 | ..... |
|---|---|---|---|---|---|---|---|---|
| 1 | 60 | 8 | FEMALE | 43 | | CARPET | CONDOMINIUM | |
| 2 | 50 | 9 | FEMALE | 24 | | FLOORING | CONDOMINIUM | |
| 3 | 100 | 4 | MALE | 52 | | TATAMI MAT | DETACHED HOUSE | |
| 4 | 80 | 5 | FEMALE | 31 | | FLOORING | CONDOMINIUM | |
| | | | | | | | | |

FIG. 14

VACUUM CLEANER AND VACUUM CLEANER SYSTEM

CROSS-REFERENCE TO RELATED APPLICATIONS

This application is based upon and claims the benefit of priority from Japanese Patent Application No. 2018-157743, filed Aug. 24, 2018 and Japanese Patent Application No. 2019-131935, filed Jul. 17, 2019; all of which are incorporated herein by reference.

TECHNICAL FIELD

Embodiments described herein relate generally to a vacuum cleaner including a secondary battery as a driving source and a vacuum cleaner system including the vacuum cleaner.

BACKGROUND ART

In a vacuum cleaner including a secondary battery as a driving source, with regard to, for example, the level of the suction force (driving force) of the electric blower receiving power supply from the secondary battery and the length of the driving time of the secondary battery, as the suction force is increased and thus the power consumption is increased, the driving time of the secondary battery is shortened, while as the suction force is decreased and thus the power consumption is decreased, the driving time of the secondary battery is lengthened. It can be said that the trade-off relation in which one thing increases and another must decrease is established between the two elements (the driving force of the electric blower and the driving time of the secondary battery). As described above, a vacuum cleaner has some elements having such trade-off relation with driving force of an electric blower.

A vacuum cleaner allowing a user to set the level of the suction force thereof is widely known. In the case where the level of the suction force is set, the user is not able to recognize how an element having trade-off relation with the level changes.

In an example, a user may focus the suction force of the electric blower, or may focus the driving time or the like of the secondary battery having trade-off relation with the suction force, depending on user's living environment and the like. With regard to the two elements in such trade-off relation, a user is enabled to recognize, as one element is made to change, how the other element changes, thereby enabling to improve the convenience of the vacuum cleaner.

BRIEF DESCRIPTION OF DRAWINGS

FIG. 14 is an explanatory diagram indicating one example of a data table to be stored in a server of the vacuum cleaner system.

DETAILED DESCRIPTION

A vacuum cleaner of the embodiments is a vacuum cleaner including a secondary battery as a power source. The vacuum cleaner includes an electric blower, a driving control part, a display input part, an arithmetic part and an indication control part. The electric blower is driven by the electric power supplied by the secondary battery. The driving control part controls the driving of the electric blower. The display input part displays a first element relevant to the operation of the electric blower, and a second element having trade-off relation with the first element. The display input part receives an input for changing at least one of the values of the first element and the second element. The arithmetic part calculates the other of the values of the first element and the second element, on the basis of the value after change received by the display input part. The indication control part makes the display input part display the value obtained by the arithmetic part. The driving control part controls the driving of the electric blower, on the basis of the value of the first element received by the display input part or the value of the first element obtained through calculation by the arithmetic part.

A first embodiment is described below with reference to the drawings.

Figure 1:
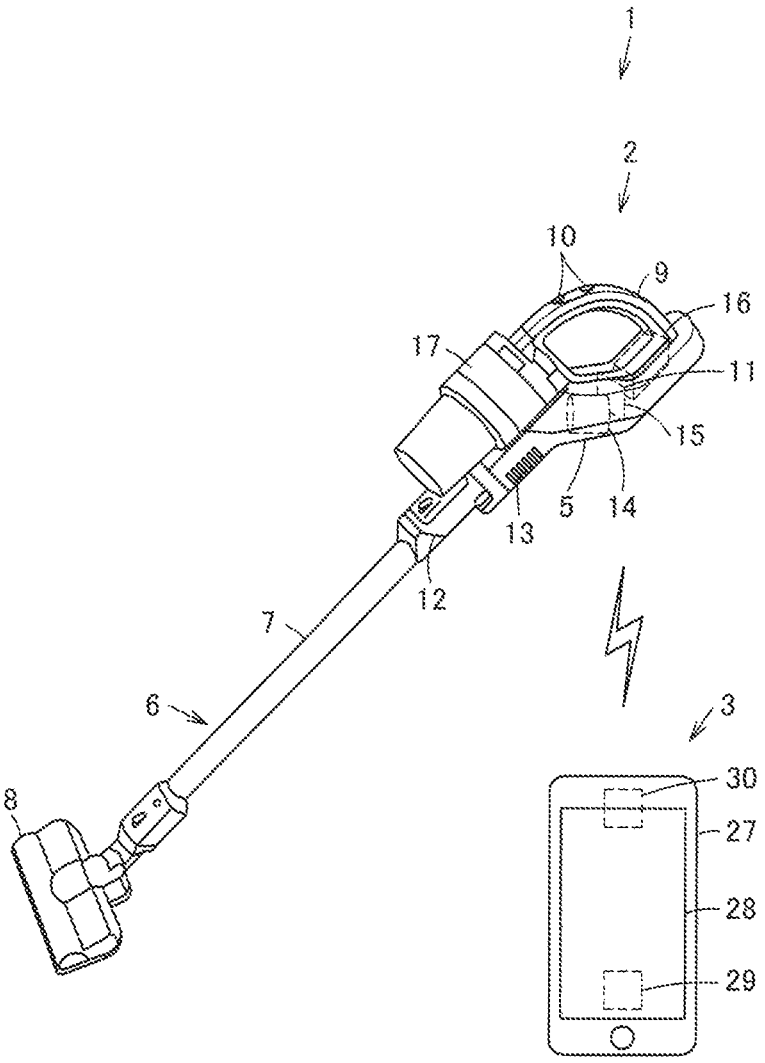
FIG. 1 is an explanatory diagram illustrating a vacuum cleaner according to a first embodiment.
Figure 2:
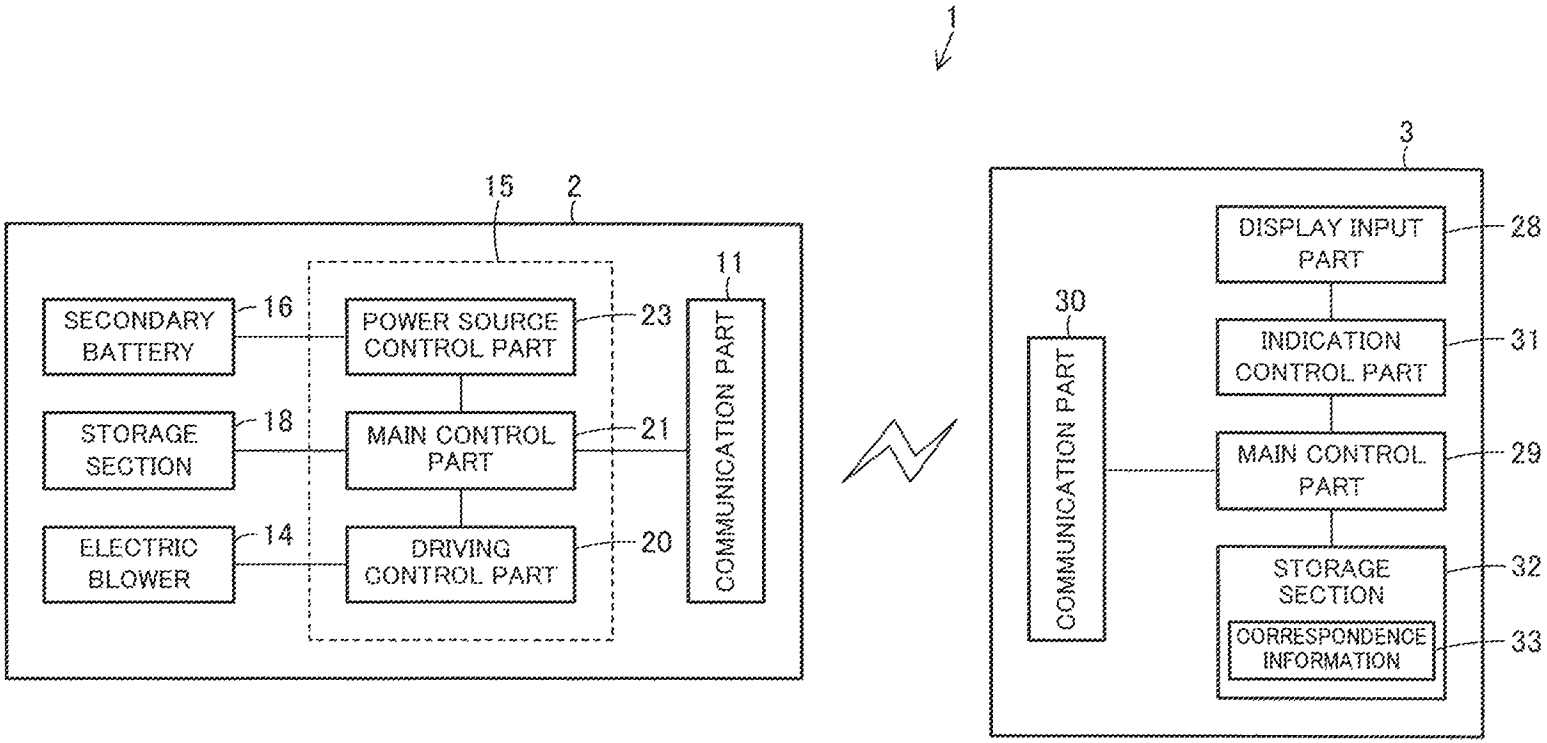
FIG. 2 is a functional block diagram illustrating the vacuum cleaner.

FIG. 1 is an explanatory diagram of a vacuum cleaner 1 according to the first embodiment. FIG. 2 is a functional block diagram of the vacuum cleaner 1 shown in FIG. 1. The configuration of the vacuum cleaner 1 is described below with reference to FIG. 1 and FIG. 2.

The vacuum cleaner 1 according to the present embodiment includes cleaning means 2 and operation means 3. The cleaning means 2 and the operation means 3 are capable of wirelessly communicating with each other.

The cleaning means 2 is the stick type cleaning means 2 allowing a user to grip a gripping part 9 to perform cleaning motion. It is noted that although stick type cleaning means is described as the cleaning means 2 in the present embodiment, the present invention is not limited thereto. The cleaning means 2 may be canister type, upright type or handy type cleaning means, an autonomously traveling type robot cleaner, or the like.

The operation means 3 allows a user to perform setting to the cleaning means 2 in accordance with the usage or performance intended by the user. The contents set by the user on the operation means 3 are transmitted to the cleaning means 2 by wireless communication, to change the setting of the cleaning means 2. In the present embodiment, the operation means 3 is a wireless communication terminal such as a smartphone with a predetermined program installed. It is noted that the operation means 3 may be a wireless communication terminal such as a mobile phone or a tablet PC, or a notebook PC or a desktop PC capable of wirelessly communicating with the cleaning means 2, not limited to the example shown in FIG. 1. Furthermore, the operation means 3 may be disposed fixedly to the cleaning means 2, or may be disposed detachably to the cleaning means 2. In this case, an external device such as a smartphone is not required separately as the operation means 3.

The cleaning means 2 includes a cleaner main body 5. An air path element 6 forming a suction air path is connected detachably to the cleaner main body 5. The air path element 6 includes an extension pipe 7 and a suction port body 8. The cleaning means 2 further includes the gripping part 9 to be gripped by a user to perform operation. A hand operation part 10 configured to set the start and stop of the cleaning means 2 is disposed on the gripping part 9. The gripping part 9 and the hand operation part 10 are included by the cleaner main body 5 in the present embodiment, or alternatively, not limited thereto, may be included by the air path element 6. It is noted that, in the case where the cleaning means 2 is of a canister type, an upright type or a handy type, the air path element 6 may be configured so as to correspond to a form of each type, while in the case where the cleaning means 2 is a robot cleaner, the air path element 6 is not required.

A suction port 12 and an exhaust port 13 are formed in the cleaner main body 5. The air path element 6 is connected to the suction port 12. An electric blower 14 is further disposed in the cleaner main body 5. A secondary battery 16 is further disposed in the cleaner main body 5, so as to supply electric power to respective parts such as brush motors disposed to the electric blower 14 and the suction port body 8. A dust-collecting unit 17 is further disposed in the cleaner main body 5, so as to catch and collect dust and dirt from the air containing dust sucked by the driving of the electric blower 14.

The cleaner main body 5 further includes a control unit 15 serving as control means configured to control the cleaning motion performed by the cleaner main body 5, and a storage section 18 configured to store a predetermined program, a parameter, setting contents and the like.

The control unit 15 includes a main control part 21 configured to control respective control parts, a communication part 11 and the like so as to control the cleaning means 2 as a whole, a driving control part 20 configured to control the driving of the electric blower 14, and a power source control part 23 configured to control the secondary battery 16.

In an example, the main control part 21 is a microcomputer in which a CPU serving as a central processing unit, a RAM serving as a temporary storage device, an EEPROM and a ROM each serving as a storage device, an input/output interface and the like are connected via buses.

The driving control part 20, which is controlled by the main control part 21, controls the driving of the electric blower 14, such as the current or rotational speed of the electric blower 14, by controlling, for example, current-carrying time or current-carrying quantity from the secondary battery 16 to the electric blower 14 on the basis of a duty ratio corresponding to an on/off time ratio.

The power source control part 23, which is controlled by the main control part 21, controls the electric power supplied by the secondary battery 16 to respective parts.

The cleaning means 2 further includes the communication part 11, and is thus capable of exchanging predetermined signals and information by wireless communication with a communication part 30 of the operation means 3. The interface between the communication part 11 and the communication part is not limited to a specific interface. Well known technique is available, for example, Wi-Fi (registered trademark), Bluetooth (registered trademark), and NFC (near field communication). The communication part 11 and the communication part 30 may be connected by wire. The interface of this case is not limited to a specific interface. Well known technique is available, for example, USB.

The operation means 3 includes a main body 27 serving as a casing body of the operation means 3. The main body 27 includes a display input part 28, a main control part 29, the communication part 30, an indication control part 31 and a storage section 32. The storage section 32 stores correspondence information 33.

The display input part 28, which is a display having a touch panel function, displays a first element E1 relevant to the operation of the electric blower 14 and a second element E2 having trade-off relation with the first element E1, and further receives an input for changing at least one of the values of the first element E1 and the second element E2.

The indication control part 31 controls the display to the display input part 28, and performs processing to transmit the input information input on the display input part 28 to the main control part 29.

In an example, the main control part 29 is a microcomputer in which a CPU serving as a central processing unit, a RAM serving as a temporary storage device, an EEPROM and a ROM each serving as a storage device, an input/output interface and the like are connected via buses. The main control part 29 functions as an arithmetic part configured to calculate, on the basis of one value after change, the other value of the elements E1, E2, wherein the one value after change has been subjected to the operation by a user on the display input part 28.

The storage section 32 stores the correspondence information 33 as table data defining the correspondence relation between the first element E1 and the second element E2 previously acquired through an experiment or the like. Upon the input for changing one value of the elements E1, E2 on the display input part 28 via the indication control part 31, the main control part 29 refers to the correspondence information 33 and outputs the other value based on the value after change. It is noted that although the main control part 29 refers to the correspondence information 33 previously stored in the storage section 32, and calculates the other value in the present embodiment, the present invention is not limited thereto. The main control part 29 may calculate the other value by using a function or the like defining the relation between the first element E1 and the second element E2. The function may be previously stored in the storage section 32.

The operation means 3 has the communication part 30, and is thus capable of exchanging predetermined signals and information by wireless communication with the communication part 11 of the cleaning means 2.

It is noted that the operation means 3 is driven by a power source such as a secondary battery, or alternatively, in the case where the cleaning means 2 and the operation means 3 are connected by wire, or the case where the operation means 3 is disposed to the cleaning means 2, the operation means 3 may receive power supply from the secondary battery 16 of the cleaning means 2.

Figure 3:
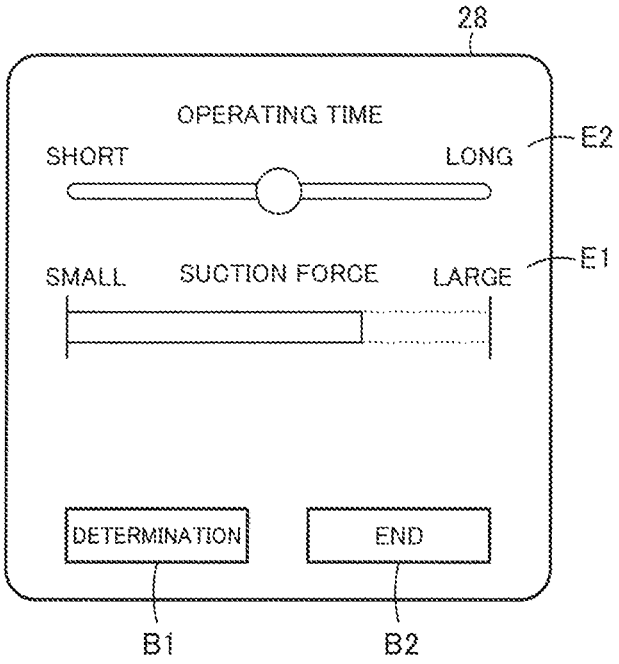
FIG. 3 is a schematic diagram illustrating an example of a function setting screen to be displayed on a display input part of the vacuum cleaner.

FIG. 3 is a schematic diagram illustrating one example of the function setting screen to be displayed on the display input part 28. In the example shown in FIG. 3, the display input part 28 displays "suction force" serving as the driving force of the electric blower 14, as the first element E1 relevant to the operation of the electric blower 14, and "operating time" of the cleaning means 2 serving as the driving time of the secondary battery 16, as the second element E2. Herein, the increase of the "suction force" corresponds to the increase of the quantity of the power supply per unit time from the secondary battery 16 to the electric blower 14. Accordingly, as the "suction force" is increased, the "operating time" is shortened, while as the "suction force" is decreased, the "operating time" is lengthened. That is, the trade-off relation in which one thing increases and another must decrease is established between the "suction force" as the first element E1 and the "operating time" as the second element E2. It can be said that the second element E2 is in the trade-off relation with the first element E1 relevant to the operation of the electric blower 14.

A user is allowed to set the "operating time," by performing sliding operation with the slider of the "operating time" on the display input part 28. That is, a user is allowed to set either long period cleaning or short period cleaning before the start of the cleaning. A predictive value (minutes) of the operating time may additionally be displayed on the portion of the slider. In default display, the slider is set at the center. In an example, when a user performs the sliding operation toward the side indicated with "long" of the value of the "operating time" on the display input part 28, the main control part 29 reads the value of the "suction force" from the correspondence information 33 by use of the value after change of the "operating time," and the indication control part 31 controls the display on the display input part 28 with respect to the "suction force" to be slid toward the small side. Conversely, in an example, when a user performs the sliding operation toward the side indicated with "short" of the value of the "operating time" on the display input part 28, the main control part 29 reads the value of the "suction force" from the correspondence information 33 by use of the value after change of the "operating time," and the indication control part 31 controls the display on the display input part 28 with respect to the "suction force" to be slid toward the large side. This allows a user to recognize how the "suction force" changes in real time as the user changes the operating time by performing the sliding operation with the slider of the "operating time."

The display input part 28 further displays a determination object B1 for determining the first element E1 or the second element E2 set by a user through touch operation, and an end object B2 for finishing the function setting screen. When a user presses the determination object B1, the parameter for driving the electric blower 14 on the basis of the value of the "suction force" of the first element E1 at the time is transmitted from the operation means 3 to the cleaning means 2 via the communication part 30. It is noted that the parameter is used to drive the electric blower 14 with the set "suction force" corresponding to the first element E1, and the parameter may be of a combination of required values, not necessarily a parameter of one element. A user may power on the cleaning means 2 at any step before pressing the determination object B1. When the determination object B1 is pressed, the indication to urge a user to power on the cleaning means 2 is output, preferably.

Furthermore, the cleaning means 2 may include a setting mode, in which the communication with the operation means 3 and the setting of a parameter are available, but in which the electric blower 14 is in an off state. In this case, during when the function setting screen of the operation means 3 is subjected to operation, the cleaning means 2 is preferably in the setting mode. The cleaning means 2 is preferably configured to start in the setting mode, upon the reception of the communication from the operation means 3.

Then, the cleaning means 2 receives a parameter via the communication part 11, and the driving control part 20 controls and allows the electric blower 14 to drive on the basis of the received parameter. When a user inputs an instruction to start the vacuum cleaner 1 by use of the hand operation part 10, the driving control part 20 controls the electric blower 14 by performing control such as switching on/off of a control element so as to make the secondary battery 16 discharge electric power and the secondary battery 16 stop the discharging at a discharge termination voltage of the set parameter, on the basis of the set parameter corresponding to user's operation by use of the operation means 3. When the driving control part 20 makes the electric blower 14 drive, the vacuum cleaner 1 sucks dust and dirt together with air via the air path element 6 through the suction port 12 to the dust-collecting unit 17, collects the dust and dirt into the dust-collecting unit 17, and uses the sucked air to cool the electric blower 14, and thereafter exhausts the air through the exhaust port 13.

Figure 4:
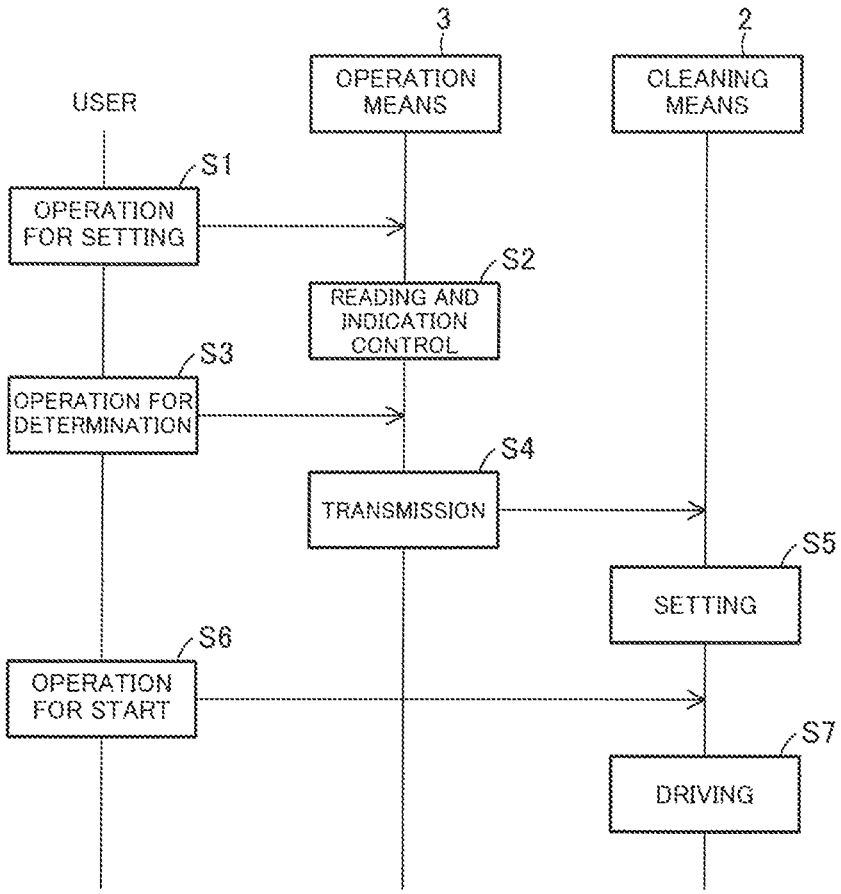
FIG. 4 is a sequence chart indicating control of the vacuum cleaner.

The operation above is described also with reference to the sequence chart shown in FIG. 4. A user performs, in step S1, the sliding operation to the first element E1 or the second element E2 on the display input part 28 of the operation means 3, and then in step S2, in the operation means 3, the indication control part 31 reads the correspondence information 33 stored in the storage section 32 in response to the input operation, and further controls the display input part 28 to change the display of the first element E1 and the second element E2 on the basis of the read value. Further when, in step S3, a user presses the determination object B1 on the display input part 28 of the operation means 3 to perform determination operation, and then in step S4, in the operation means 3, the communication part 30 transmits, to the cleaning means 2, the parameter corresponding to the setting displayed on the display input part 28 at the time. Thereafter, in step S5, in the cleaning means 2, the communication part 11 receives the transmitted parameter, and the driving control part 20 sets and allows the electric blower 14 to drive on the basis of the parameter. Then in step S6, a user inputs start operation by using the hand operation part 10, and in step S7, in the cleaning means 2, the driving control part 20 starts the driving of the electric blower 14 on the basis of the set parameter. In addition, the processing from step S1 to step S5 is enabled to be executed even during driving (processing after step S7). The processing from step S1 to step S5 may be executed after the start in a predetermined mode.

It is noted that, as a user operates the "operating time," the "suction force" is displayed variably in the description of the example shown in FIG. 3, or alternatively as a user operates the "suction force," the "operating time" may be displayed variably. Further alternatively, both of the "operating time"

and the "suction force" may be displayed as operable elements, and each time either one is operated, the other element may be displayed variably.

Although, in the description of the example shown in FIG. 3, the "operating time" is displayed as the slider with which a user is able to perform the sliding operation, GUI is not specifically limited thereto. For example, a spin box or a knob may be available, or a graph or the like may be displayed, having orthogonal coordinate axes of the operating time of the cleaning means 2 and the suction force of the electric blower 14.

The "operating time" of the cleaning means 2 may further be changed continuously. Alternatively, a user may be allowed to select one from the plurality of previously-determined "operating times" as radio buttons or the like, and the "suction force" corresponding to the selected "operating time" may be displayed.

In addition, a reset button or the like may be displayed on the display input part 28, having the function of resetting the first element E1 and the second element E2 changed by a user, to default.

The vacuum cleaner 1 according to the first embodiment described above makes the operation means 3 display the first element E1 relevant to the operation of the electric blower 14 and the second element E2 having trade-off relation with the first element E1. As a user performs the input for changing one value of the first element E1 or the second element E2, the other value is displayed variably. Further, the vacuum cleaner 1 is made to drive on the basis of the value after change of the first element E1 relevant to the operation of the electric blower 14. That is, when changing one value of these two elements E1, E2 in trade-off relation, a user is allowed to recognize how the other value changes.

Accordingly, a user is allowed to recognize the level of the driving performance of the vacuum cleaner 1 to be used right after in balance with the operating time, and is thus able to make the vacuum cleaner 1 drive with user's intended setting. This enables to improve the convenience of the vacuum cleaner 1.

Second Embodiment

The second embodiment is described next with reference to FIG. 5. It is noted that the configurations and the actions same as those of the embodiment described above are denoted by the same reference signs and the descriptions thereof are omitted.

Figure 5:
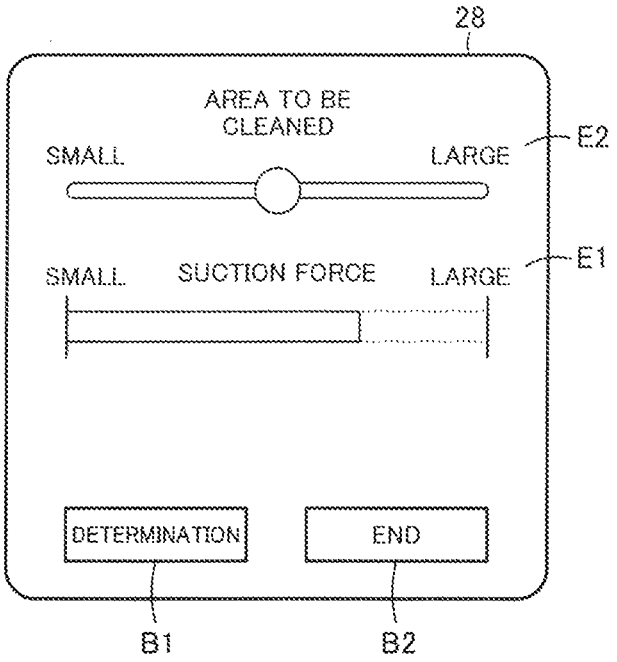
FIG. 5 is a schematic diagram illustrating an example of a function setting screen to be displayed on a display input part of a vacuum cleaner according to a second embodiment.

FIG. 5 is a schematic diagram illustrating another example of the function setting screen to be displayed on the display input part 28. In the example shown in FIG. 5, the display input part 28 displays "suction force" serving as the driving force of the electric blower 14, as the first element E1 relevant to the operation of the electric blower 14, and the size of "area to be cleaned" by the cleaning means 2, as the second element E2. Herein, assuming that cleaning is performed with a fixed power, a large size of the "area to be cleaned" corresponds to a long operating time, and a small size of the "area to be cleaned" corresponds to a short operating time. Accordingly, as the "suction force" is increased, the "area to be cleaned" (area in which cleaning is allowed) becomes small, while as the "suction force" is decreased, the "area to be cleaned" becomes large. That is, the trade-off relation in which one thing increases and another must decrease is established between the "suction force" as the first element E1 and the "area to be cleaned" as the second element E2. It can be said that the second element E2 is in the trade-off relation with the first element E1 relevant to the operation of the electric blower 14.

A user is allowed to set the "area to be cleaned," by performing the sliding operation with the slider of the "area to be cleaned" on the display input part 28. A user sets either cleaning of a large area or cleaning of a small area. A predictive value (for example, $m^2$ or the number of tatami mats) of the "area to be cleaned" may additionally be displayed on the portion of the slider. In the default display, the slider is set at the center. In an example, when a user performs the sliding operation toward the side indicated with "large" of the value in the "area to be cleaned" on the display input part 28, the main control part 29 reads the value of the "suction force" from the correspondence information 33 by use of the value after change of the "area to be cleaned," and the indication control part 31 controls the display on the display input part 28 with respect to the "suction force" to be slid to the small side. Conversely, in an example, when a user performs the sliding operation toward the side indicated with "small" of the value of the "area to be cleaned," the main control part 29 reads the value of the "suction force" from the correspondence information 33 by use of the value after change of the "area to be cleaned," and the indication control part 31 controls the display on the display input part 28 with respect to the "suction force" to be slid to the large side. This allows a user to recognize how the "suction force" changes in real time as the user changes the area to be cleaned by performing the sliding operation with the slider of the "area to be cleaned."

When a user presses the determination object B1, the parameter for driving the electric blower 14 corresponding to the value of the "suction force" at the time is transmitted from the operation means 3 to the cleaning means 2 via the communication part 30.

When the cleaning means 2 receives the parameter via the communication part 11, the driving control part 20 controls the electric blower 14 to drive on the basis of the parameter.

The vacuum cleaner 1 according to the second embodiment described above allows a user to recognize the level of the driving performance of the vacuum cleaner 1 to be used right after in balance with the size of the area to be cleaned, and allows the vacuum cleaner 1 to drive with user's intended setting. This improves the convenience of the vacuum cleaner 1.

Third Embodiment

The third embodiment is described next with reference to FIG. 6. It is noted that the configurations and the actions same as those of the embodiments described above are denoted by the same reference signs and the descriptions thereof are omitted.

Figure 6:
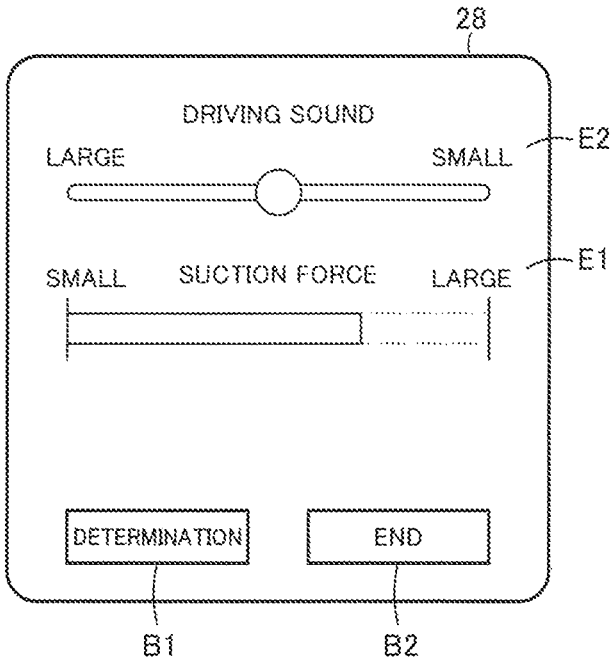
FIG. 6 is a schematic diagram illustrating an example of a function setting screen to be displayed on a display input part of a vacuum cleaner according to a third embodiment.

FIG. 6 is a schematic diagram illustrating another example of the function setting screen to be displayed on the display input part 28. In the example shown in FIG. 6, the display input part 28 displays "suction force" serving as the driving force of the electric blower 14, as the first element E1 relevant to the operation of the electric blower 14, and "driving sound" of the electric blower 14, as the second element E2.

Herein, a user expects the small "driving sound" caused by the operation of the electric blower 14 during the cleaning motion. As the "suction force" is increased, the "driving sound" of the electric blower 14 necessarily becomes large, while as the "driving sound" is intended to be reduced, the "suction force" must be decreased. That is, the trade-off relation in which one thing increases and another must decrease is established between the "suction force" as the first element E1 and the "driving sound" as the second element E2. It can be said that the second element E2 is in the trade-off relation with the first element E1 relevant to the operation of the electric blower 14.

A user is allowed to set the "driving sound," by performing the sliding operation with the slider of the "driving sound" on the display input part 28. A user sets the "driving sound" in an allowable level. A predictive value (for example, dB) of the "driving sound" may additionally be displayed on the portion of the slider. In the default display, the slider is set at the center. In an example, when a user performs the sliding operation toward the side indicated with "small" of the value of the "driving sound" on the display input part 28, the main control part 29 reads the value of the "suction force" from the correspondence information 33 by use of the value after change of the "driving sound," and the indication control part 31 controls the display on the display input part 28 with respect to the "suction force" to be slid to the small side. Conversely, in an example, when a user performs the sliding operation toward the side indicated with "large" of the value of the "driving sound" on the display input part 28, the main control part 29 reads the value of the "suction force" from the correspondence information 33 by use of the value after change of the "driving sound," and the indication control part 31 controls the display on the display input part 28 with respect to the "suction force" to be slid to the large side. This allows a user to recognize how the "suction force" changes in real time as the user changes the driving sound, by performing the sliding operation with the slider of the "driving sound."

When a user presses the determination object B1, the parameter for driving the electric blower 14 corresponding to the value of the "suction force" at the time is transmitted from the operation means 3 to the cleaning means 2 via the communication part 30.

When the cleaning means 2 receives the parameter via the communication part 11, the driving control part 20 controls the electric blower 14 to drive on the basis of the parameter.

The vacuum cleaner 1 according to the third embodiment described above allows a user to recognize the level of the driving performance of the vacuum cleaner 1 to be used right after in balance with the driving sound of the cleaning means, and allows the vacuum cleaner 1 to drive with user's intended setting. This improves the convenience of the vacuum cleaner 1.

Fourth Embodiment

The fourth embodiment is described next with reference to FIG. 7 and FIG. 8. It is noted that the configurations and the actions same as those of the first embodiment described above are denoted by the same reference signs and the descriptions thereof are omitted.

Figure 7:
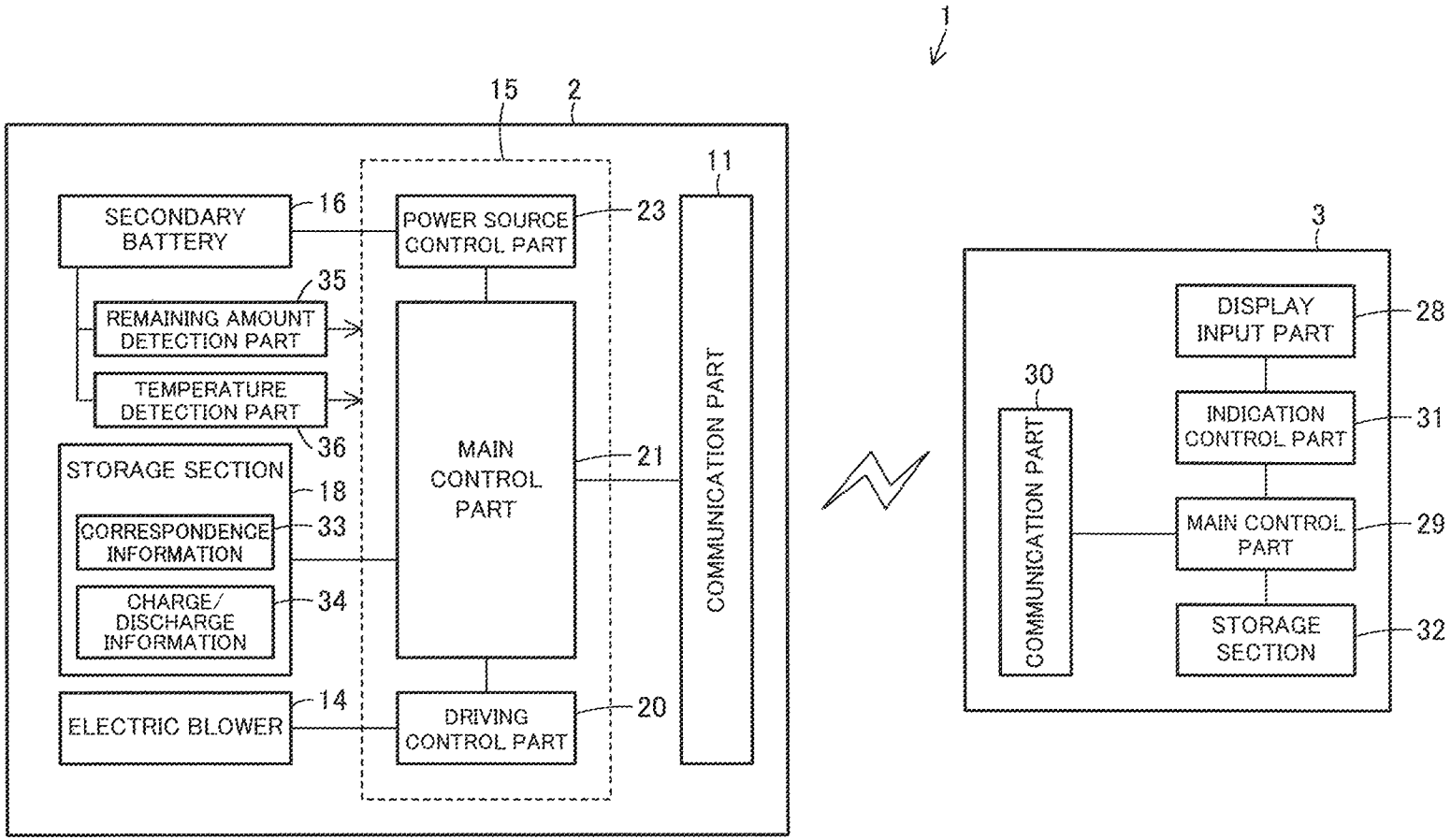
FIG. 7 is a functional block diagram illustrating a vacuum cleaner according to a fourth embodiment.

FIG. 7 is a functional block diagram of the vacuum cleaner 1 according to the fourth embodiment. The cleaning means 2 according to the present embodiment includes a remaining amount detection part 35 configured to detect a remaining amount of the secondary battery 16, a temperature detection part 36 configured to detect a temperature of the secondary battery 16, and the storage section 18 configured to store the correspondence information 33 and charge/discharge information 34, and the main control part 21 functions as an arithmetic part.

The remaining amount detection part 35 detects a remaining amount of the secondary battery 16. The remaining amount of the secondary battery 16 may be detected by a known method, for example, a voltage measurement system or a new method, and the method is not limited to a specific method. The temperature detection part 36 detects a temperature of the secondary battery 16. The temperature of the secondary battery 16 herein includes a temperature at a predetermined position in the vicinity of the secondary battery 16. That is, the temperature detection by the temperature detection part 36 includes the detection of the temperature having predetermined relation with the temperature of the secondary battery 16. The detection results by the remaining amount detection part 35 and the temperature detection part 36 are transmitted to the main control part 21. Furthermore, the power source control part 23 transmits, to the main control part 21, history information on charging/discharging such as the number of times of charging and the number of times of discharging (the number of times of charging/discharging cycle), charging/discharging rate and the like in the secondary battery 16, and the storage section 18 stores the information as the charge/discharge information 34. It is noted that the cleaning means 2 includes the remaining amount detection part 35 and the temperature detection part 36 in the description of the example of the present embodiment, or alternatively the cleaning means 2 may include at least either one of them.

Figure 8:
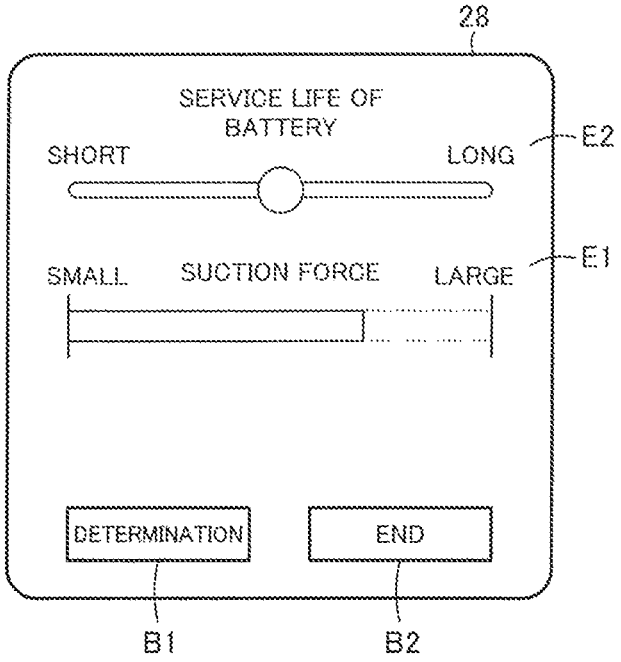
FIG. 8 is a schematic diagram illustrating an example of a function setting screen to be displayed on a display input part of the vacuum cleaner.

FIG. 8 is a schematic diagram illustrating another example of the function setting screen to be displayed on the display input part 28. In the example shown in FIG. 8, the display input part 28 displays "suction force" serving as the driving force of the electric blower 14, as the first element E1 relevant to the operation of the electric blower 14, and a service life of the secondary battery 16 ("service life of battery"), as the second element E2. The service life of the secondary battery 16 herein is, for example, the upper limit of the number of times of charging/discharging cycle of the secondary battery 16.

Herein, a user expects a long "service life of battery" of the secondary battery 16. As the "suction force" is increased, the load to the secondary battery 16 becomes large, and accordingly the "service life of battery" of the secondary battery 16 is shortened. That is, the trade-off relation in which one thing increases and another must decrease is established between the "suction force" as the first element E1 and the "service life of battery" as the second element E2. It can be said that the second element E2 is in the trade-off relation with the first element E1 relevant to the operation of the electric blower 14.

A user is allowed to set the "service life of battery," by performing the sliding operation with the slider of the "service life of battery" on the display input part 28. A user sets the "service life of battery" with user's intended level. A predictive value of the "service life of battery" (for example, the number of times of charging/discharging) may additionally be displayed on the portion of the slider. In the default display, the slider is set at the center. In an example, when a user performs the sliding operation toward the side indicated with "short" of the value of the "service life of battery" on the display input part 28, such information is transmitted from the operation means 3 to the cleaning means 2, and the main control part 21 reads the value of the "suction force" from the correspondence information 33 by use of the value after change of the "service life of battery," and transmits the value to the operation means 3. The operation means 3 controls the display on the display input part 28 with respect to the "suction force" to be slid to the large side, on the basis of the information. Conversely, in an example, when a user performs the sliding operation toward the side indicated with "long" of the value of the "service life of battery" on the display input part 28, the indication control part 31 controls the display on the display input part 28 with respect to the "suction force" to be slid to the small side. This allows a user to recognize how the "suction force" changes in real time, as the user changes the service life of battery by performing the sliding operation with the slider of the "service life of battery."

When a user presses the determination object B1, the driving control part 20 controls the electric blower 14 to drive, on the basis of the parameter for driving the electric blower 14 corresponding to the value of the "suction force" at the time.

The vacuum cleaner 1 according to the fourth embodiment described above allows a user to recognize the level of the driving performance of the vacuum cleaner 1 to be used right after in balance with the service life of the secondary battery, and allows the vacuum cleaner 1 to drive with user's intended setting. This improves the convenience of the vacuum cleaner 1.

It is noted that as the secondary battery 16 with less remaining amount of battery is used repeatedly, the service life of the secondary battery 16 becomes shorter, while as the secondary battery 16 with more remaining amount of battery is used repeatedly, the service life of the secondary battery 16 becomes longer. Moreover, as the secondary battery 16 under a higher temperature is used repeatedly, the service life of the secondary battery 16 becomes shorter, while as the secondary battery 16 under a lower temperature is used repeatedly, the service life of the secondary battery 16 becomes longer.

Preferably, the main control part 21 predicts the service life of the battery to be displayed on the display input part 28, on the basis of the remaining amount of the secondary battery 16 detected by the remaining amount detection part 35, and the temperature of the secondary battery 16 detected by the temperature detection part 36, and makes the display input part 28 display the predicted value.

Preferably, the main control part 21 further refers to the charge/discharge information 34 in the storage section 18, to predict the service life of the secondary battery 16. The prediction of the service life of the secondary battery 16 is performed in consideration of the charging/discharging history of the secondary battery 16, thereby enabling to improve the accuracy in prediction of the service life of the secondary battery 16.

As described above, the service life of battery to be displayed on the display input part 28 is predicted on the basis of remaining amount, temperature, charging/discharging history and the like of the secondary battery 16, and the predicted value is displayed. A user is allowed to set the relation between the predicted value and the suction force. Accordingly, a user is able to recognize the level of the driving performance of the vacuum cleaner 1 to be used right after in balance with the service life of the secondary battery 16, and the vacuum cleaner 1 is enabled to drive with user's intended setting. This improves the convenience of the vacuum cleaner 1.

Other Embodiments

In each of the examples of the embodiments described above, the display input part 28 displays the first element E1 relevant to the operation of the electric blower 14 and the second element E2 having trade-off relation with the first element E1 in one-to-one manner, and allows a user to set at least either one of the elements E1, E2. Alternatively, the display input part 28 may display a plurality of the second elements E2 having the trade-off relation described above with the first element E1 relevant to the operation of the electric blower 14, and may allow a user to set at least either one of them, and the plurality of second elements E2 may be displayed interlockingly and variably.

In this case, in the correspondence information 33, the first element E1 and the plurality of second elements E2 may mutually have correspondence relation, and thus the values of the first element E1 and the other elements E2 may vary in accordance with one value of the second element E2.

Figure 9:
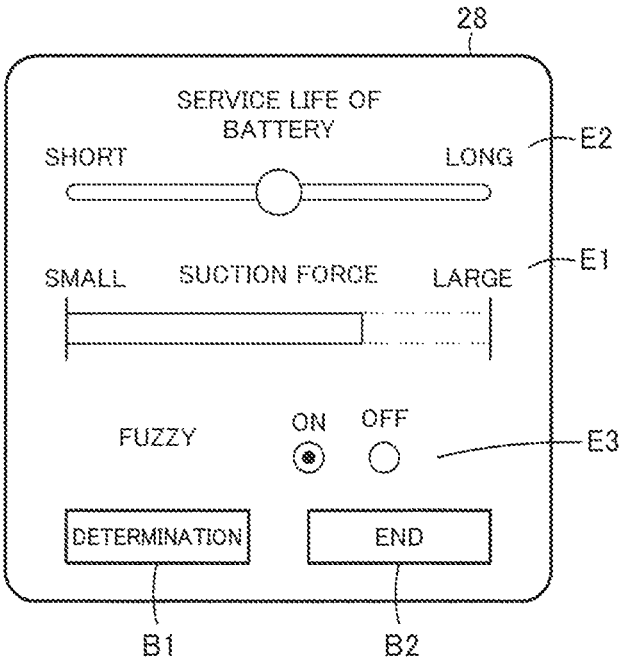
FIG. 9 is a schematic diagram illustrating an example of a function setting screen to be displayed on a display input part of a vacuum cleaner according to a fifth embodiment.
Figure 10:
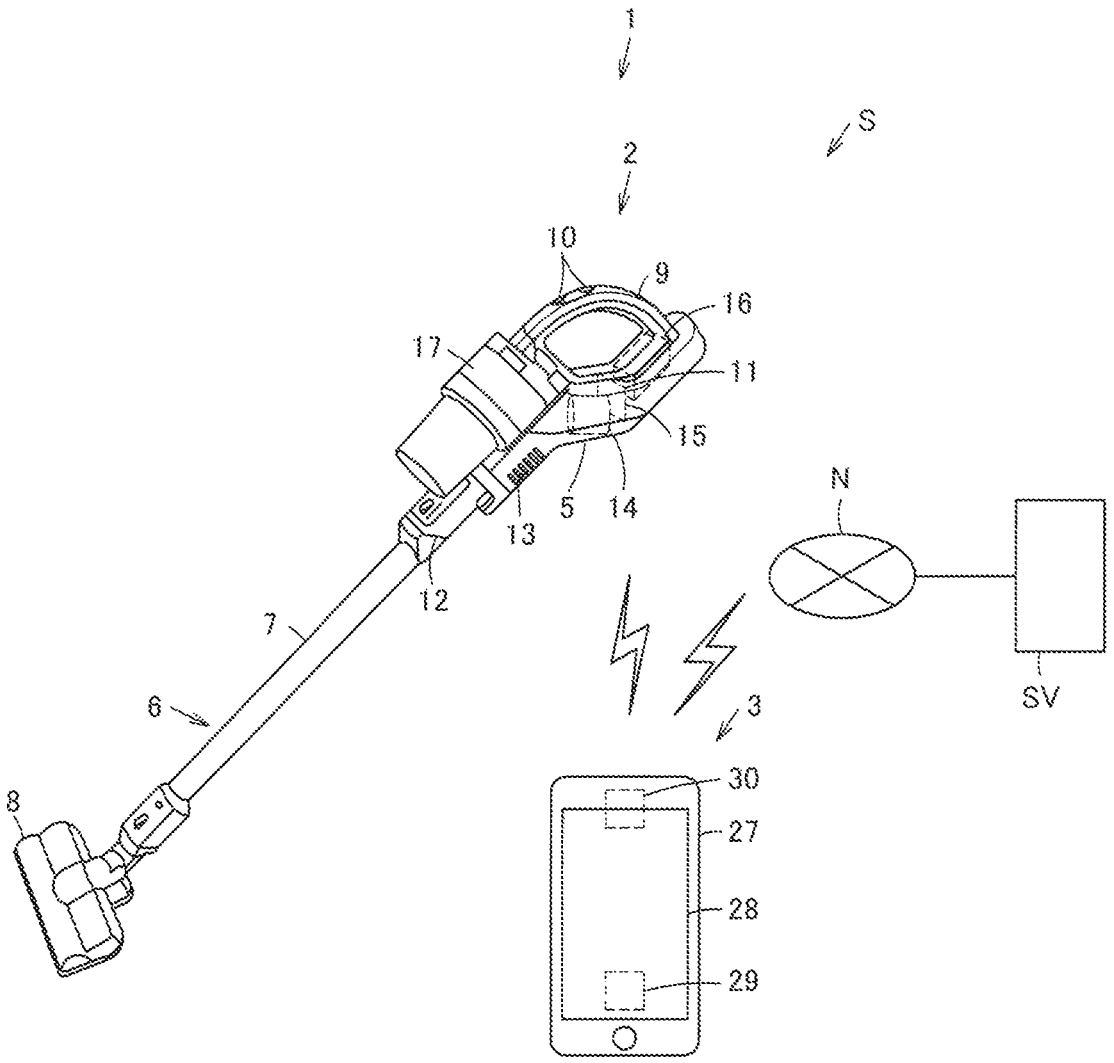
FIG. 10 is an explanatory diagram illustrating a vacuum cleaner system according to a sixth embodiment.

In each of the examples of the embodiments described above, the display input part 28 displays the first element E1 relevant to the operation of the electric blower 14 and the second element E2 having trade-off relation with the first element E1 in one-to-one manner, and allows a user to set at least either one of the elements E1, E2. The display input part 28 may additionally display a third element E3 relevant to the operation of the electric blower 14, and may allow to set the value of the third element E3 as in a fifth embodiment shown in FIG. 9. In the example shown in FIG. 9, the on or off of the fuzzy control to change the level of the suction operation of the electric blower 14 is enabled to be set, as the third element E3, by selecting either one with a radio button. The third element E3 is not limited thereto.

In this case, the correspondence information 33 may include correspondence relation between the first element E1 and the second element E2 of both the case of the fuzzy control on and the case of the fuzzy control off, and the electric blower 14 may be controlled in accordance with on/off of the fuzzy control and in accordance with the value of the first element E1.

As described above, the third element E3 relevant to the operation of the electric blower 14 is enabled to be set, thereby enabling the operation performance of the cleaning means 2 to be set in more detail.

In each of the descriptions of the examples of the embodiments described above, the display input part 28 is a display having a touch panel function. Alternatively, the display input part 28 may include a display device having a display function, and a button, a keyboard, a pointing device or the like having an input function.

In each of the descriptions of the examples of the first to third embodiments described above, in response to the change of one value of the elements E1, E2, the main control part 29 of the operation means 3 calculates the other value. Alternatively, in the first to the third embodiments described above, the main control part 21 of the cleaning means 2 may perform the calculation as in the fourth embodiment.

Moreover, a vacuum cleaner system S may be built, in which the vacuum cleaner 1 according to each of the embodiments described above is capable of communicating with a server SV via a network N, as in a sixth embodiment shown in FIG. 10 to FIG. 15.

The network N is an external network such as the internet. The network N enables wire connection or wireless connection to the vacuum cleaner 1 via relaying means such as a home gateway. In the present embodiment, the network N allows wireless connection to at least either one of the communication part 11 of the cleaning means 2 and the communication part 30 of the operation means 3. The server SV is connected to the network N, so as to allow exchanging of data via the network N, and further to allow storage and output of data.

The vacuum cleaner system S according to the present embodiment allows the server SV to store at least the value having relation with the value received by the display input part 28, via the network N.

The value having relation with the value received by the display input part 28 refers to the value having predetermined relation with the first element E1 or the second element E2 input by a user on the display input part 28. That is, the value having relation with the value received by the display input part 28 may be the value itself of the first element E1 or the second element E2 to be displayed on the display input part 28, or may be a single parameter or a plurality of parameters or the like corresponding to the value. Preferably, the server SV basically stores the value having relation with the first element E1 and the value having relation with the second element E2, respectively. When at least either one of these values is stored, the other value is enabled to be calculated by the server SV, the main control part 29 of the operation means 3 or the like, and accordingly the other value may not necessarily be stored. The server SV may additionally and separately store the value having relation with the third element E3.

The timing at which the server SV stores the value having relation with the value received by the display input part 28 is allowed to be set arbitrarily. In an example, the value may be stored when the element to be displayed on the display input part 28 is set in the cleaning means 2, or when other operation than the setting of element is performed. That is, the value may be stored in the server SV, interlocking with the setting of element by a user to the cleaning means 2. Alternatively, the sequence or screen setting to be intentionally executed by a user may be set separately.

Figure 11:
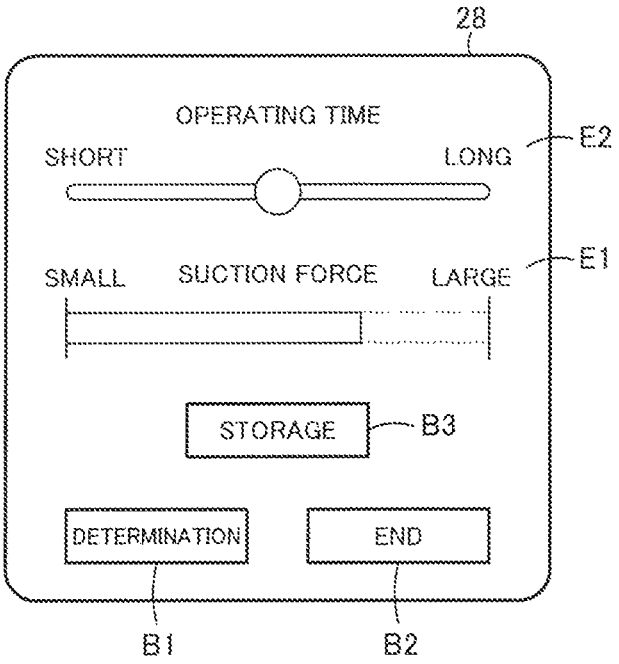
FIG. 11 is a schematic diagram illustrating an example of a function setting screen to be displayed on a display input part of a vacuum cleaner of the vacuum cleaner system.

FIG. 11 is a schematic diagram illustrating one example of the function setting screen to be displayed on the display input part 28. In the example shown in FIG. 11, as in the first embodiment, the display input part 28 displays "suction force" serving as the driving force of the electric blower 14, as the first element E1 relevant to the operation of the electric blower 14, and "operating time" of the cleaning means 2 serving as the driving time of the secondary battery 16, as the second element E2. Alternatively, the first element E1 and the second element E2 may be set arbitrarily as in the second to fifth embodiments, and the third element E3 may be displayed additionally. In the case of the example shown in FIG. 11, the display input part 28 displays a storage determination object B3 for determining the storage in the server SV, of the first element E1 or the second element E2 set by a user through touch operation, separately from the determination object B1 and the end object B2. When a user presses the storage determination object B3, the value (s) having relation with the value(s) of the first element E1 and/or the second element E2 at the time are/is transmitted from the network N to the server SV via the communication part 30, and are/is stored in the server SV. In the case where the end object B2 is pressed without pressing of the storage determination object B3 after the first element E1 and/or the second element E2 set or changed, the indication to urge a user to check whether or not the value(s) should be stored in the server SV is output preferably.

The determination object B1 may further serve as a storage determination object, without the storage determination object B3. That is, when the parameter corresponding to the value of the first element E1 or the second element E2 at the time when a user presses the determination object B1 is transmitted from the operation means 3 to the cleaning means 2 via the communication part 30, the value or the corresponding parameter thereof may be transmitted from the network N to the server SV via the communication part 30, and may be stored in the server SV. In this case, the value transmitted from the operation means 3 to the cleaning means 2 may be identical to or may be different from the value transmitted via the network N to the server SV.

It is noted that when a value is stored in the server SV, the indication to urge a user to check whether or not the value should be stored in the server SV is output preferably before the value is transmitted from the communication part 30.

At least either one of user attribute information and information on area to be cleaned may further be stored in the server SV. In this case, at least either one of user attribute information and information on area to be cleaned is stored in the server SV so as to be preferably associated with the value having relation with the value received by the display input part 28.

The user attribute information, which may be set arbitrarily, is the information on, for example, gender, age and family structure of user, existence or non-existence of pet, and resident living alone. One type or a plurality of types of the user attribute information may be stored in the server SV.

The information on area to be cleaned, which may be set arbitrarily, is the information on, for example, type of floor surface to be cleaned by the cleaning means 2, type of user's house such as a condominium or a detached house, type of room to be cleaned in the case where the area to be cleaned by the cleaning means 2 is a room such as a kitchen, living room and bedroom, and user's address. One type or a plurality of types of the information on area to be cleaned may be stored in the server SV.

The user attribute information or the information on area to be cleaned may be input by a user via the operation means 3. Alternatively, in the case where the storage section 18 of the cleaning means 2, the storage section 32 of the operation means 3 or the like stores map information on area to be cleaned, the user attribute information or the like, at least a part of such information may be used.

Preferably, a user is allowed to input various types of information through the information setting screen displayed on the display input part 28. The information setting screen to be displayed on the display input part 28 is preferably controlled by the indication control part 31 so that the information setting screen and the function setting screen are allowed to be replaced mutually. At least either one of the user attribute information and the information on area to be cleaned may be allowed to be input. In the description of the example according to the present embodiment, the both types of information are allowed to be input.

Figure 12:
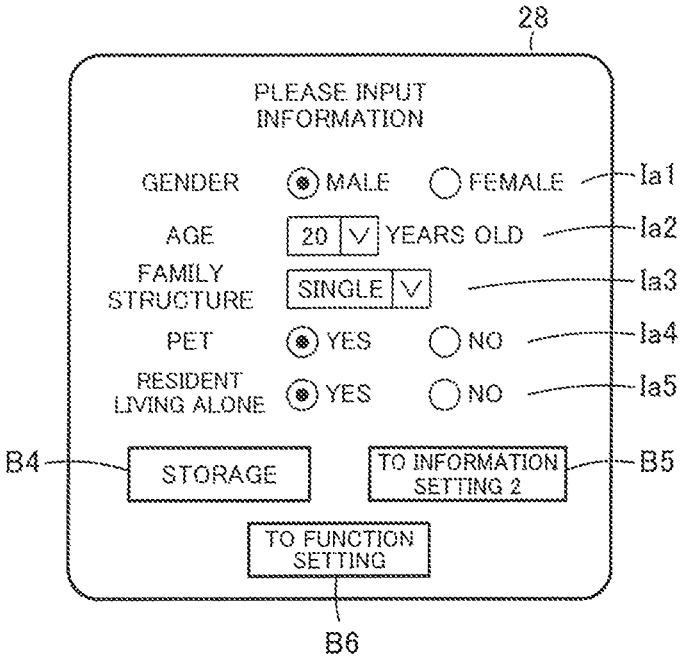
FIG. 12 is a schematic diagram illustrating one example of an information setting screen to be displayed on the display input part of the vacuum cleaner.

FIG. 12 is a schematic diagram illustrating one example of the information setting screen to be displayed on the display input part 28. In the example shown FIG. 12, the user attribute information is to be input. In the example shown in FIG. 12, the display input part 28 displays "gender," "age," "family structure," "existence/non-existence of pet" and "resident living alone or not" respectively as a user attribute information Ia1 to an user attribute information Ia5. The display input part 28 further displays a storage object B4 for determining the user attribute information Ia1 to Ia5 set by a user and storing them in the server SV, a replacing object B5 for replacing the screen with the information setting screen on which the information on area to be cleaned is to be input, and an end object B6 for finishing the information setting screen and replacing the screen with the function setting screen. When a user presses the storage object B4, the values respectively having relation with the information Ia1 to Ia5 at the time are transmitted from the operation means 3 to the network N via the communication part 30, and are stored in the server SV. When a user presses the replacing object B5 or the end object B6, the indication control part 31 controls the display input part 28 to display the screen corresponding to each of the contents. It is noted that when the information setting screen shown as the example in FIG. 12 is replaced with another screen, the indication for checking whether or not the user attribute information Ia1 to Ia5 should be stored in the server SV is preferably output before the replacing.

Figure 13:
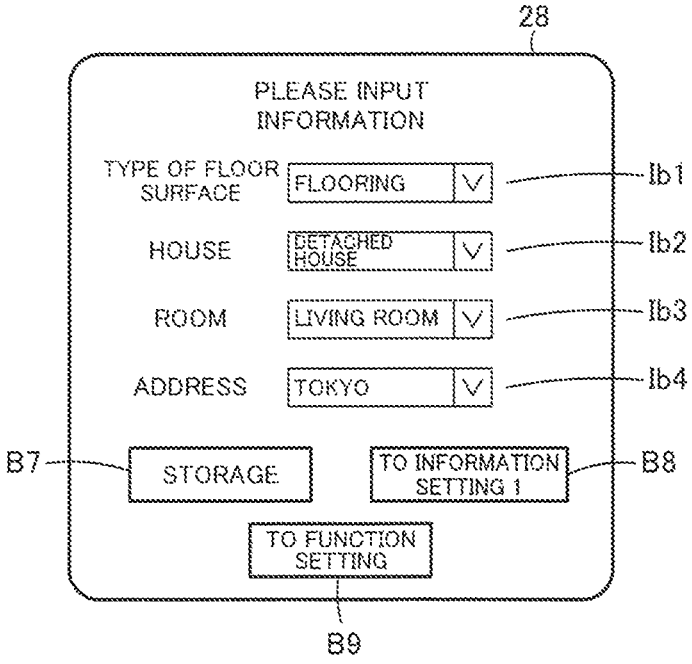
FIG. 13 is a schematic diagram illustrating another example of the information setting screen to be displayed on the display input part of the vacuum cleaner.

FIG. 13 is a schematic diagram illustrating another example of the information setting screen to be displayed on the display input part 28. In the example shown FIG. 13, the information on area to be cleaned is to be input. In the example shown in FIG. 13, the display input part 28 displays "type of floor surface," "type of house," "type of room" and "address" respectively as an information on area to be cleaned Ib1 to an information on area to be cleaned Ib4. The display input part 28 further displays a storage object B7 for determining the information on area to be cleaned Ib1 to Ib4 set by a user and storing them in the server SV, a replacing object B8 for replacing the screen with the information setting screen on which the user attribute information is to be input, and an end object B9 for finishing the information setting screen and replacing the screen with the function setting screen. When a user presses the storage object B7, the values respectively having relation with the information Ib1 to Ib4 at the time are transmitted from the operation means 3 to the network N via the communication part 30, and are stored in the server SV. When a user presses the replacing object B8 or the end object B9, the indication control part 31 controls the display input part 28 to display the screen corresponding to each of the contents. It is noted that when the information setting screen shown as the example in FIG. 13 is replaced with another screen, the indication for checking whether or not the information on area to be cleaned Ib1 to Ib4 should be stored in the server SV is preferably output before the replacing.

The examples of the information setting screen shown in FIG. 12 and FIG. 13 may be individually set so that the screens are replaced mutually via the replacing objects B5, B8, or may be set in one screen. In the case where all pieces of information are hardly displayed on the display input part 28 in one screen size of the display input part 28, such as the case where many pieces of information are to be input on the displayable area of the display input part 28, the screen may be scrolled up and down or laterally so that the entire is allowed to be displayed.

FIG. 14 shows one example of the information to be stored in the server SV. In the example shown in FIG. 14, the server SV stores a value having relation with the first element E1, a value having relation with the second element E, user attribute information of a user having input these values, and information on area to be cleaned, for each user as a data table.

The values and information stored in the server SV may be browsable by a user on the display input part 28 of the operation means 3. The indication control part 31 of the operation means 3 may make the display input part 28 display the value acquired from among the values stored in the server SV as a default value of at least either one of the first element E1 and the second element E2. The value acquired from among the values stored in the server SV may be the value having relation with the first element E1 and/or the second element E2 stored in the server SV by another user. In the case where a plurality of other users exist, the value acquired from among the values stored in the server SV may be the value having relation with the first element E1 and/or the second element E2 stored by the greatest number of users in the plurality of other users, or the average value or the like of the values having relation with the first elements E1 and/or the second elements E2 stored by other users. The average value or the like may be obtained through calculation and output by the server SV, or may be obtained through calculation by the main control part 29 or the like of the operation means 3 on the basis of the value output by the server SV.

More preferably, the indication control part 31 may make the display input part 28 display, as a default value of at least either one of the first element E1 and the second element E2, the value acquired on the basis of the values stored in the server SV taking into consideration at least either one of the user attribute information and the information on area to be cleaned stored in the server SV so as to be associated with the values stored in the serer SV. That is, in the case where a user inputs at least either one of the user attribute information and the information on area to be cleaned, the value having relation with the value stored together with the input information, in the values stored in the server SV, may be output by the server SV. The value having relation with the value stored together with the input information may be the value having relation with the first element E1 and/or the second element E2 stored in the server SV by another user having the information identical or similar to the user attribute information or the information on area to be cleaned input by a user. In the case where a plurality of other users having identical or similar information exist, the value having relation with the value stored together with the input information may be the value having relation with the first element E1 and/or the second element E2 stored by the greatest number of users in such other users, or the average value or the like of the values having relation with the first elements E1 and/or the second elements E2 stored by such other users. The average value or the like may be obtained through calculation and output by the server SV, or may be obtained through calculation by the main control part 29 or the like of the operation means 3 on the basis of the value output by the server SV. The value itself to be displayed on the display input part 28 may be output by the server SV. Alternatively, the value output by the server SV may be received by the communication part 30, and thereafter the value obtained through calculation by the main control part 29 may be displayed on the display input part 28.

The server SV may output a value automatically when the attribute information or the information on area to be cleaned area is stored by a user, or may output a value in response that a user separately performs operation such as for reading.

Figure 15:
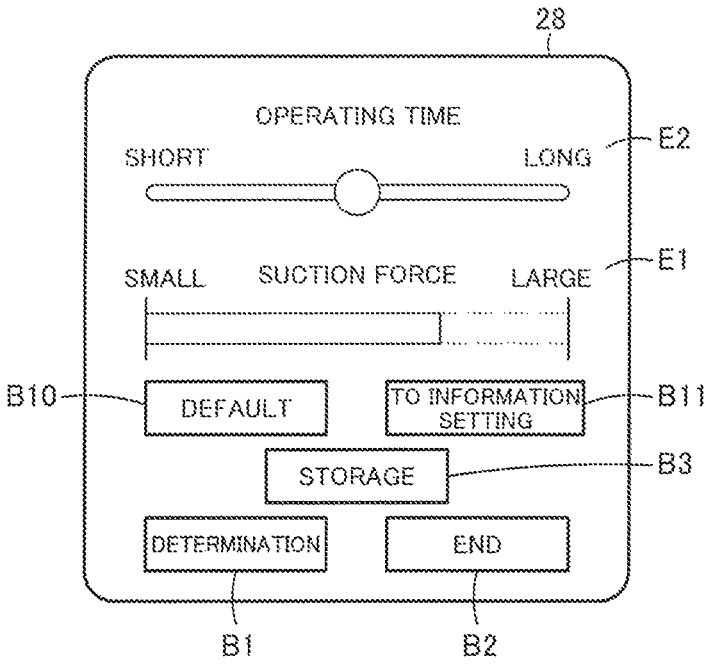
FIG. 15 is a schematic diagram illustrating an example of a function setting screen allowing to display a default value, to be displayed on the display input part of the vacuum cleaner.

FIG. 15 is a schematic diagram illustrating one example of the function setting screen to be displayed on the display input part 28. In the example shown in FIG. 15, as in the first embodiment, the display input part 28 displays "suction force" serving as the driving force of the electric blower 14, as the first element E1 relevant to the operation of the electric blower 14, and "operating time" of the cleaning means 2 serving as the driving time of the secondary battery 16, as the second element E2. Herein, the first element E1 and the second element E2 may be arbitrarily set as in the second to fifth embodiments, and the third element E3 may be displayed additionally. In the case of the example shown in FIG. 15, the display input part 28 displays the determination object B1, the end object B2 and the storage determination object B3, and further separately a default display object B10 for displaying a default value, and a replacing object B11 for replacing the screen with the information setting screen. When a user presses the default display object B10, the user attribute information and/or the information on area to be cleaned together with a requesting signal are output from the communication part 30 of the operation means 3, and are transmitted from the network N to the server SV. The server SV, after receiving the requesting signal, refers to the user attribute information and/or the information on area to be cleaned received together with the requesting signal, and outputs the value having relation with the first element E1 and/or the second element E2 relevant to the information. The output value is transmitted to the operation means 3 via the network N. In the operation means 3, when the communication part 30 receives the transmitted value, the main control part 29 processes the value, and the indication control part 31 controls the display input part 28 on the basis of the value, thereby making the display input part 28 display a default value. The indication control part 31 may make the display input part 28 replace the value displayed on the display input part 28 immediately before with a default value, or may make the display input part 28 display a default value separately from the value displayed immediately before, thereby allowing a user to compare the values. When a user presses the replacing object B11, the indication control part 31 controls the display input part 28 to replace the screen with the information setting screen on which the user attribute information and/or the information on area to be cleaned are/is input.

It is noted that, in the examples of the information setting screens shown in FIG. 12 and FIG. 13, when any one of the objects B5, B6, B8, B9 is pressed, the values having relation with the first element E1 and/or the second element E2 relevant to the respective types of input information, together with a requesting signal, may be output by the server SV, and may be transmitted to the operation means 3 via the network N.

The value having relation with the value received by the display input part 28 and the various types of information may be individually transmitted from the communication part 30 to the server SV via the network N, or alternatively when one of them is transmitted, the other may also be transmitted.

In the description of the above example, the value having relation with the value received by the display input part 28 and the various types of information are transmitted from the communication part 30 of the operation means 3 via a home gateway or the like from the network N to the server SV. Alternatively, the values and the various types of information may be transmitted from the communication part 30 of the operation means 3 through the communication part 11 or the like of the cleaning means 2 indirectly from the network N to the server SV.

Moreover, a plurality of groups of the information per user, not limited to one group of the information per user, may be stored in the server SV. In this case, a plurality of groups of the information may be stored in the server SV so as to be associated with stored dates and the like, whereby the value and the information set previously are allowed to be selectively output by the server SV.

FIG. 11, FIG. 12, FIG. 13 and FIG. 15 merely show display examples, the GUIs to be displayed on the respective screens are not limited to these specific forms.

As described above, at least the values having relation with the values received by the display input part 28 are allowed to be stored in the server SV, whereby the information on cleaning methods by users is allowed to be acquired and used effectively.

The value acquired from among the values stored in the server SV is allowed to be displayed on the display input part 28 as a default value of at least either one of the first element E1 and the second element E2, thereby easily informing a user of the value set by another user, as a default value.

The server SV is capable of storing at least either one of the user attribute information and the information on area to be cleaned, and thus the information on cleaning method by a user for each user attribute and each area to be cleaned is allowed to be acquired.

In this case, the display input part 28 is allowed to display the value acquired on the basis of the values stored in the server SV taking into consideration at least either one of the user attribute information and the information on area to be cleaned stored in the server SV, as a default value of at least either one of the first element E1 and the second element E2, whereby a user is able to easily recognize, as a default value, the values set by other users having the attribute identical to or similar to that of the user, or other users who clean the areas identical to or similar to the area to be cleaned by the user.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A vacuum cleaner comprising a secondary battery as a driving source, the vacuum cleaner comprising:

an electric blower driven by electric power supplied by the secondary battery;

a driving control part configured to control driving of the electric blower;

a display input part configured to display a first element relevant to operation of the electric blower, and a second element having negative correlation with the first element, and configured to receive input of a temporary setting value of at least either one of the first element and the second element, in a setting mode in which the electric blower is in an off state;

an arithmetic part configured to obtain a predictive value of the other of the first element and the second element on a basis of the temporary setting value received by the display input part in the setting mode; and an indication control part configured to make the display input part display the temporary setting value and the predictive value at any time, on a basis of the input of the display input part and the arithmetic part in the setting mode, wherein the driving control part starts the electric blower on a basis of the temporary setting value or the predictive value as a true setting value by inputting an instruction to start the vacuum cleaner in the setting mode.

2. The vacuum cleaner according to claim 1, the vacuum cleaner comprising:

a cleaner including the secondary battery, the electric blower and the driving control part; and an operator including the display input part, the arithmetic part and the indication control part, wherein the cleaner and the operator respectively have communication parts capable of communicating with each other.

3. The vacuum cleaner according to claim 1, the vacuum cleaner comprising:

a cleaner including the secondary battery, the electric blower, the driving control part and the arithmetic part; and an operator including the display input part and the indication control part, wherein the cleaner and the operator respectively have communication parts capable of communicating with each other.

4. The vacuum cleaner according to claim 1, the vacuum cleaner comprising:

a storage section storing correspondence information defining correspondence relation between the first element and the second element, wherein the arithmetic part obtains, on a basis of the temporary setting value of the either one of the first element and the second element, the predictive value of the other by referring to the storage section.

5. The vacuum cleaner according to claim 1, wherein the first element is a driving force of the electric blower, and the second element is a driving time by the secondary battery.

6. The vacuum cleaner according to claim 1, wherein the first element is a driving force of the electric blower, and the second element is a size of an area to be cleaned.

7. The vacuum cleaner according to claim 1, wherein the first element is a driving force of the electric blower, and the second element is a driving sound volume of the electric blower.

8. The vacuum cleaner according to claim 1, wherein the first element is a driving force of the electric blower, and the second element is a service life of the secondary battery.

9. The vacuum cleaner according to claim 8, the vacuum cleaner comprising at least either one of:

a remaining amount detection part configured to detect a remaining amount of the secondary battery; and a temperature detection part configured to detect a temperature of the secondary battery, wherein the arithmetic part obtains the predictive value of the service life of the secondary battery, on a basis of at least one of the remaining amount of the secondary battery detected by the remaining amount detection part and the temperature of the secondary battery detected by the temperature detection part.

10. The vacuum cleaner according to claim 8, the vacuum cleaner comprising:

a storage section storing a charging and discharging history of the secondary battery, wherein the arithmetic part obtains the predictive value of the service life of the secondary battery, on a basis of the charging and discharging history of the secondary battery stored in the storage section.

11. The vacuum cleaner according to claim 1, wherein the display input part displays a third element relevant to the operation of the electric blower, and receives the temporary setting value and input with respect to the third element, and the arithmetic part obtains the predictive value, on a basis of the temporary setting value and the temporary setting value of the third element.

12. The vacuum cleaner according to claim 1, wherein the display input part is a touch panel display.

13. A vacuum cleaner system comprising:

the vacuum cleaner according to claim 1; and a server capable of communicating with the vacuum cleaner via a network, and capable of storing at least a value having relation with the value received by the display input part.

14. The vacuum cleaner system according to claim 13, wherein the indication control part is capable of making the display input part display a value obtained from among the values stored in the server, as a default value of at least either one of the first element and the second element.

15. The vacuum cleaner system according to claim 13, wherein the server is capable of storing at least either one of user attribute information and information on area to be cleaned.

16. The vacuum cleaner system according to claim 15, wherein the indication control part is capable of making the display input part display, as a default value of at least either one of the first element and the second element, a value obtained on a basis of the values stored in the server, taking into consideration at least either one of the user attribute information and the information on area to be cleaned stored in the server.

* * * * *